US012486649B2

(12) United States Patent
Fujiwara et al.

(10) Patent No.: US 12,486,649 B2
(45) Date of Patent: Dec. 2, 2025

(54) SYSTEM FOR DETECTING ABNORMAL OPERATION OF WORK MACHINES

(71) Applicant: KOBELCO CONSTRUCTION MACHINERY CO., LTD., Hiroshima (JP)

(72) Inventors: Sho Fujiwara, Hiroshima (JP); Yukihiro Hoso, Hiroshima (JP); Shingun Kyu, Hiroshima (JP); Yoshiki Munemasa, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 149 days.

(21) Appl. No.: 18/575,970

(22) PCT Filed: Mar. 11, 2022

(86) PCT No.: PCT/JP2022/011027
§ 371 (c)(1),
(2) Date: Jan. 2, 2024

(87) PCT Pub. No.: WO2023/286351
PCT Pub. Date: Jan. 19, 2023

(65) Prior Publication Data

US 2024/0318409 A1 Sep. 26, 2024

(30) Foreign Application Priority Data

Jul. 13, 2021 (JP) ..... 2021-115784

(51) Int. Cl.
*E02F 9/26* (2006.01)
*E02F 3/43* (2006.01)

(52) U.S. Cl.
CPC ..... *E02F 9/267* (2013.01); *E02F 3/437* (2013.01); *E02F 9/265* (2013.01)

(58) Field of Classification Search
CPC . E02F 9/267; E02F 9/265; E02F 9/262; E02F 9/264; E02F 3/437
See application file for complete search history.

(56) References Cited

U.S. PATENT DOCUMENTS 5,301,522 A * 4/1994 Ikemizu ..... D06F 34/16 68/12.16
5,819,202 A * 10/1998 Sato ..... G05B 23/0243 700/184

(Continued)

FOREIGN PATENT DOCUMENTS

CN 109564086 A 4/2019
CN 111902585 A 11/2020

(Continued)

OTHER PUBLICATIONS

Behere, S. A Generic Framework for Robot Motion Planning and Control, Google Scholar, KTH—School of Computer Science and Communication (CSC), Centres, Centre for Autonomous Systems (CAS), Thesis, 2010, pp. 1-71. (Year: 2010).*

(Continued)

*Primary Examiner* — Russell Frejd
(74) *Attorney, Agent, or Firm* — Oblon, McClelland, Maier & Neustadt, L.L.P.

(57) ABSTRACT

A system for detecting that the motion of an automatically operated work machine is abnormal includes: a target position acquisition unit that acquires target position information about a monitoring target part; an abnormal motion region setting unit that sets an abnormal motion region (Rab) based on the target position information; a current position acquisition unit that acquires a current position of the monitoring target part; and an abnormal motion judgment unit. The abnormal motion region (Rab) is set outside the area occupied by the monitoring target part when the monitoring target part is located at the target position. The abnormal (Continued)

motion judgment unit judges whether or not the current position is within the abnormal motion region (Rab).

6 Claims, 8 Drawing Sheets

(56) References Cited

U.S. PATENT DOCUMENTS

| | | | | |
|---|---|---|---|---|
| 2019/0316321 | A1* | 10/2019 | Gazza | E02F 9/2214 |
| 2021/0002859 | A1 | 1/2021 | Wu | |
| 2021/0254312 | A1 | 8/2021 | Ol et al. | |
| 2022/0388791 | A1 | 12/2022 | Fujiwara et al. | |
| 2023/0071015 | A1* | 3/2023 | Wu | E02F 3/437 |

FOREIGN PATENT DOCUMENTS

| | | | | |
|---|---|---|---|---|
| JP | 11-293708 | A | 10/1999 | |
| JP | 2001-303621 | A | 10/2001 | |
| JP | 2020-12323 | A | 1/2020 | |
| JP | 2020-33836 | A | 3/2020 | |
| JP | 2021-050474 | A | 4/2021 | |
| JP | 2021-55256 | A | 4/2021 | |
| JP | 7076020 | B1 * | 5/2022 | E02F 9/245 |
| WO | WO 2017/002749 | A1 | 1/2017 | |
| WO | WO 2019/181874 | A1 | 9/2019 | |

OTHER PUBLICATIONS

Yousefi, N. System Level Monitoring for Time-Varying Conditions with Application to Ground Engaging Equipment, Google Scholar, University of Alberta Department of Mechanical Engineering, Thesis, 2015, pp. 1-127. (Year: 2015).*

USP Publication 2023/0332377 as Translation of JP 2021014988 (Year: 2021).*

International Search Report issued May 10, 2022 in PCT/JP2022/011027, filed on Mar. 11, 2022, 2 pages.

Extended European Search Report issued Oct. 12, 2024 in European Patent Application No. 22841701.0, 6 pages.

* cited by examiner

SYSTEM FOR DETECTING ABNORMAL OPERATION OF WORK MACHINES

TECHNICAL FIELD

The present invention relates to a system for detecting abnormal motion of a work machine.

BACKGROUND ART

Conventionally known are techniques for automatic operation of a work machine. For example, Patent Document 1 discloses a technique that includes imaging a work machine to be automatically operated and making the work machine soil at an appropriate location based on the imaged data.

However, this technique does not allow it to be detected that the motion of the work machine automatically operated is abnormal.

CITATION LIST

Patent Literature

Patent Literature 1: Japanese Unexamined Patent Publication No. Heisei 11-293708

SUMMARY OF INVENTION

The object of the present invention is to provide a system capable of detecting that the motion of an automatically operated work machine is abnormal.

Provided is an abnormal motion detection system that detects abnormal motion of a work machine to be automatically operated. The abnormal motion detection system includes a work machine, a target position acquisition unit, an abnormal motion region setting unit, a current position acquisition unit, and an abnormal motion judgment unit. The work machine includes a monitoring target part and is automatically operated to move the monitoring target part. The target position acquisition unit acquires target position information which is information on a target position of the monitoring target part. The abnormal motion region setting unit sets an abnormal motion region based on the target position information acquired by the target position acquisition unit. The abnormal motion region is a region for judging that an abnormal motion is present when the monitoring target part is located within the abnormal motion region, being set outside an area occupied by the monitoring target part when the monitoring target part is located at the target position. The current position acquisition unit acquires information on a current position, which is a current position of the monitoring target part. The abnormal motion judgment unit judges whether or not the current position acquired by the current position acquisition unit is within the abnormal motion region.

BRIEF DESCRIPTION OF DRAWINGS

FIG. 4 is a plan view showing a normal motion region set for the work machine and the like.

DETAILED DESCRIPTION

There will be described a preferred embodiment of the present invention with reference to FIGS. 1-8.

Figure 1:
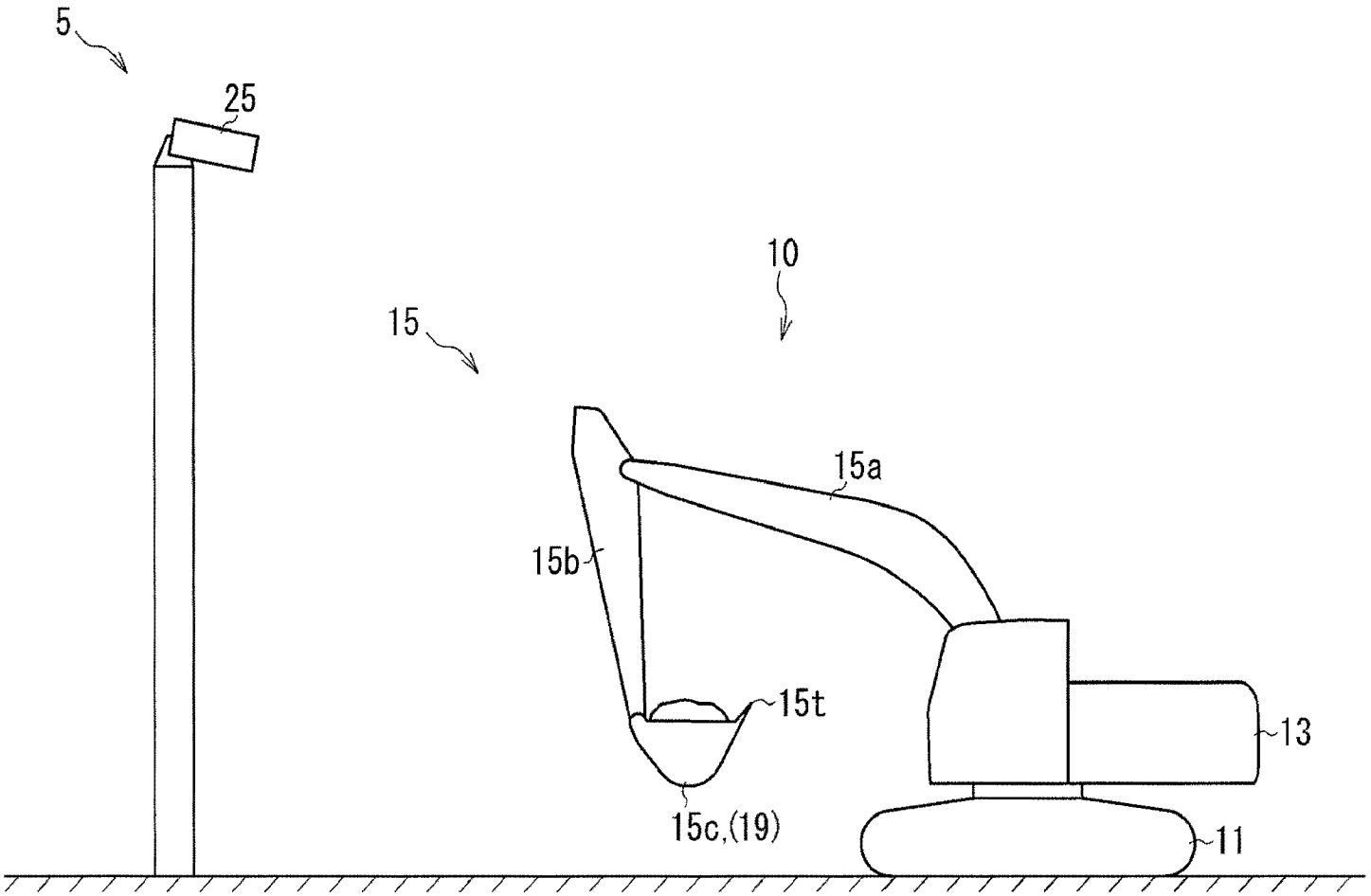
FIG. 1 is a side view of a work machine and other elements of an abnormal motion detection system according to an embodiment of the present invention.

FIG. 1 shows a work machine 10 and other elements included in an abnormal motion detection system 5 according to the embodiment. The abnormal motion detection system 5 is a system for detecting an abnormal motion of the work machine 10. The abnormal motion detection system 5 is provided, for example, at a work site of the work machine 10, for example, a construction site. In addition to the work machine 10, the abnormal motion detection system 5 includes a plurality of elements shown in FIG. 2, namely, a posture detection unit 21, an imaging device 25, a work machine controller 30, and a monitoring controller 40.

The work machine 10 is a machine to perform work, for example, a construction machine to perform construction work. The work machine 10 is capable of being automatically operated. The work machine 10 shown in FIG. 1 is an excavator. The work machine 10 may be a work machine that is not an excavator, for example, a crane. The work machine 10 includes a lower traveling body 11, an upper slewing body 13, an attachment 15, a plurality of non-illustrated actuators, and a drive control unit 17 shown in FIG. 2.

The lower traveling body 11 is capable of traveling on the ground. The lower traveling body 11, for example, includes a pair of crawlers.

Figure 3:
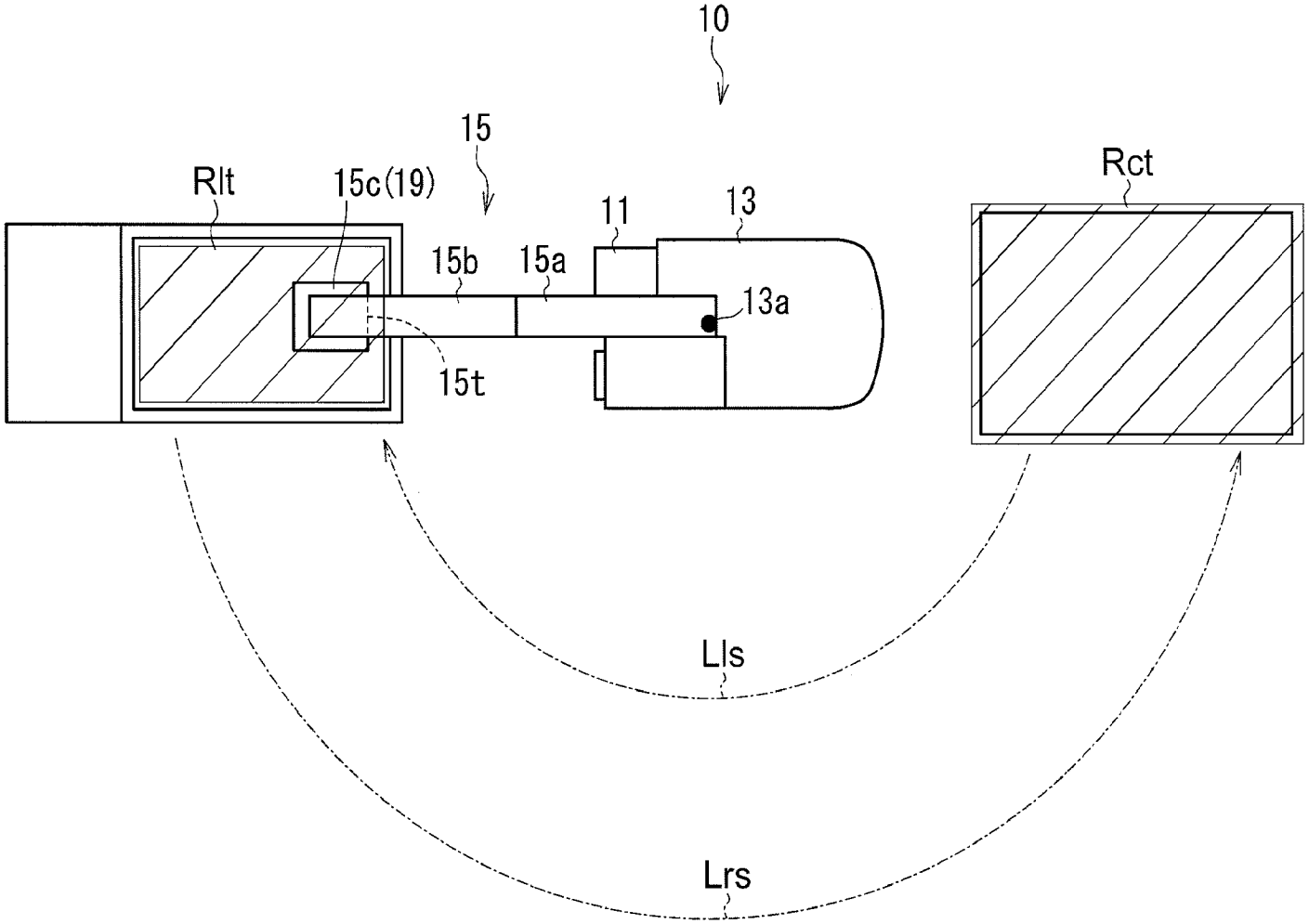
FIG. 3 is a plan view showing an example of a work plan by the work machine shown in FIG. 1.

The upper slewing body 13 is mounted on the lower traveling body 11 capably of slewing. Specifically, as shown in FIG. 3, the upper slewing body 13 is capable of slewing about a vertical slewing center axis 13*a* (extending in the depth direction in FIG. 3) with respect to the lower traveling body 11.

The attachment 15 is a part that performs a work on a work object. The attachment 15 according to the present embodiment includes a boom 15*a*, an arm 15*b*, and an end attachment 15*c*. The boom 15*a* has a proximal end to be connected to the upper slewing body 13 capably of being raised and lowered (vertically rotated), and a distal end opposite to the proximal end. The arm 15*b* has a proximal end vertically rotatably coupled to the distal end of the boom 15*a*, and a distal end opposite to the proximal end. The end attachment 15*c* is vertically rotatably attached to the distal end of the arm 15*b* to form the distal end of the attachment 15. The end attachment 15*c* shown in FIG. 1 is a bucket capable of perform a motion of scooping sediment and the like. The end attachment 15*c* may be a device that performs other work motions, for example, a nipping device such as a grapple, or a crushing or excavation device such as a breaker. The work object, which is the object of the work by the attachment 15, may be either of earth and sand, a stone, a structure such as concrete, and a waste. The plurality of actuators make respective motions to actuate a plurality of movable parts included in the work machine 10, respectively. The plurality of actuators, for example, include: a slewing motor for slewing the upper slewing body 13 with respect to the lower traveling body 11; a boom cylinder for raising and lowering the boom 15*a* with respect to the upper slewing body 13; an arm cylinder for rotating the arm 15*b* with respect to the boom 15*a*; and an end cylinder for rotating the end attachment 15*c* with respect to the arm 15*b*.

Figure 2:
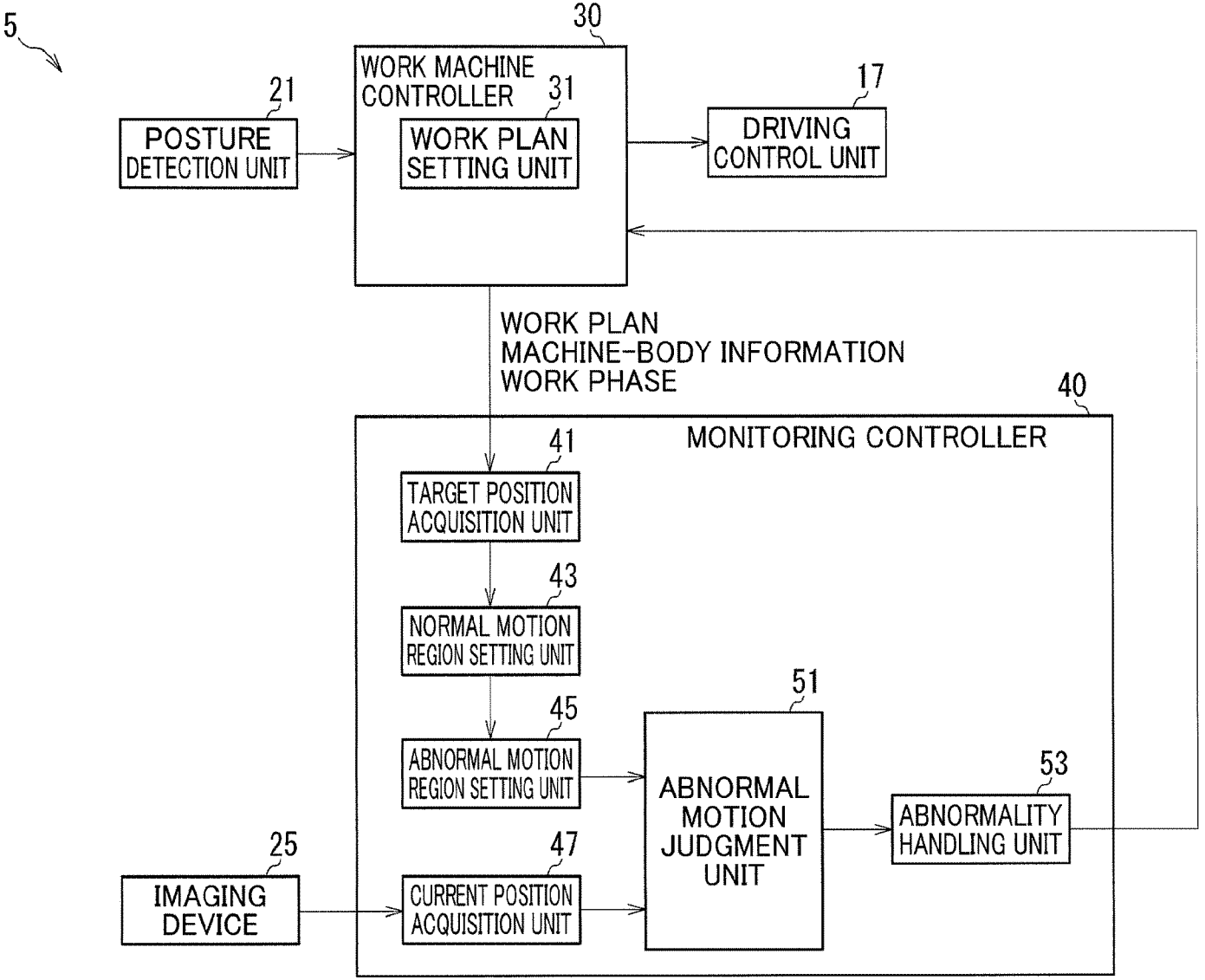
FIG. 2 is a block diagram showing the abnormal motion detection system.

The drive control unit 17 shown in FIG. 2 controls at least a part of a plurality of actuator motions that are respective motions of the plurality of actuators. The plurality of actuator motions, for example, include: the motion of the slewing motor for slewing the upper slewing body 13 with respect to the lower traveling body 11; the motion of the boom cylinder for raising and lowering the boom 15*a* with respect to the upper slewing body 13; the motion of the arm cylinder for rotating the arm 15*b* with respect to the boom 15*a*; and the motion of the end cylinder that rotates the end attachment 15*c* with respect to the arm 15*b*.

The work machine 10 is set with a monitoring target part 19. The monitoring target part 19 is a part to be monitored for judging whether or not the work machine 10 is performing an abnormal motion. The monitoring target part 19 may be either the entire work machine 10 or a specified part of the work machine 10. The examples of the specific part include the whole or a part of the upper slewing body 13, the rear end of the upper slewing body 13 (e.g., a counterweight), the whole or a part of the lower traveling body 11, and the whole or a part of the attachment 15. The monitoring target part 19 preferably includes the farthest part from the slewing center axis 13*a* shown in FIG. 3 in the attachment 15. In the present embodiment, the monitoring target part 19 is the distal end of the attachment 15, namely, the end attachment 15*c*. Since the distal end of the attachment is directly involved in work in a typically work machine, monitoring the distal end of the attachment 15 as in the present embodiment allows it to be properly detected whether or not the work machine 10 is performing an abnormal motion. The monitoring target part 19 according to the present embodiment is the whole of the end attachment 15*c*. The monitoring target part 19, however, may be a specific part 15*t* of the end attachment 15*c*, for example, the tip of the bucket which is the end attachment 15*c* shown in FIG. 1.

The posture detection unit 21 shown in FIG. 2 detects the posture of the work machine 10. Each of the posture detection unit 21, the imaging device 25, the work machine controller 30, and the monitoring controller 40 may be either installed on the work machine 10 or placed outside the work machine 10. The posture detection unit 21, for example, detects the position and orientation of a reference part with respect to a work site, the reference part serving as a reference of the work machine 10 shown in FIG. 1. The reference part is preferably a specific part of the upper slewing body 13 or the lower traveling body 11, for example, a part to which the proximal end part of the boom 15*a* is connected, in the upper slewing body 13, namely, a boom foot.

The posture detection unit 21 shown in FIG. 2 detects the posture of the work machine 10 by use of a positioning system. The positioning system is, for example, a satellite positioning system such as a GNSS (Global Navigation Satellite System). The positioning system, alternatively, may be one with use of a total station.

The posture detection unit 21, alternatively, may include a plurality of detectors to determine the posture of the work machine 10 based on the results of detection by the plurality of detectors. The plurality of detectors, for example, include at least a part of the following detectors: a detector that detects a slewing angle or a slewing angular velocity of the upper slewing body 13 with respect to the lower traveling body 11; a detector that detects a rotation angle (rising angle) or a rotation angular velocity of the boom 15*a* with respect to the upper slewing body 13; a detector that detects a rotation angle or a rotation angular velocity of the arm 15*b* with respect to the boom 15*a*; and a detector that detects a rotation angle or a rotational angular velocity of the end attachment 15*c* with respect to the arm 15*b*. Each of the detectors is, for example, a sensor that detects a rotation angle (e.g., a rotary encoder), an inclination sensor that detects an inclination to the horizontal plane, or a sensor that detects the stroke of a cylinder that forms the actuator.

The imaging device 25 captures the image of an imaging object. The imaging object is, for example, the monitoring target part 19. The imaging object may include either a part other than the monitoring target part 19 in the work machine 10 or an object around the work machine 10 (e.g., at least one of the vehicle shown in FIG. 8 and the building E2). The imaging device 25 preferably detects two-dimensional information (e.g., position or shape) of the imaging object, and more preferably detects three-dimensional information on the imaging object. Specifically, the imaging device 25 is preferably configured to acquire an image that contains distance information (depth information) of the imaging object, namely, a distance image. The imaging device 25 may detect three-dimensional information on the imaging object, for example, based on the distance image and the two-dimensional image. The abnormal motion detection system 5 may include either just a single imaging device 25 or a plurality of imaging devices 25. The imaging device 25 may be either installed on the work machine 10 or placed outside the work machine 10. The imaging device 25 may include either a camera that detects two-dimensional information (a monocular camera) or a device that detects three-dimensional information using laser light, such as a LIDAR (Light Detection and Ranging) or a TOF (Time Of Flight) sensor. The imaging device 25 may, alternatively, include a device that uses radio waves to detect three-dimensional information (e.g., a millimeter-wave radar or a stereo camera).

The work machine controller 30 performs control of the automatic operation of the work machine 10 shown in FIG. 1. As shown in FIG. 2, each of the work machine controller 30 and the monitoring controller 40 is a computer that performs input/output of signals, arithmetic operation (processing), storage of information, etc. and these functions are realized by an operation unit that executes a program stored in respective storage units of the work machine controller 30 and the monitoring controller 40.

The work machine controller 30 transmits information to the monitoring controller 40. The information, in the present embodiment, includes machine-body information on the work machine 10, work plan, and work phase. The machine-body information includes at least one of the size and shape of at least a part of the plurality of components of the work machine 10, the plurality of components including the lower traveling body 11, the upper slewing body 13, the boom 15*a*, the arm 15*b*, and the end attachment 15*c* in the present embodiment. The information transmitted by the work machine controller 30 preferably includes information on the posture of the work machine 10 detected by the posture detection unit 21. The work plan will be specifically described below. The information about the work phase is information about in which work phase of a plurality of below-described work phases the work machine 10 is working when being automatically operated, namely, the information on the current work phase.

As shown in FIG. 2, the work machine controller 30 includes a work plan setting unit 31. The work plan setting unit 31 sets a work plan for the work machine 10. The information about the work plan is information related to the target for the work machine 10 to execute the work plan. The information about the work plan, in the present embodiment, includes: a target locus or target route of the travel of the work machine 10; a target region (a target capture region Rct and a target release region Rrt which are specifically below-described) for a work by a part of the end attachment 15*c* shown in FIG. 3, the part including at least the specific part 15*t*; and a target locus of the specific part 15*t* (a target lift-up slewing locus Lls and a target return slewing locus Lrs which are specifically below-described). The information about the work plan preferably includes at least a part of the slewing angle of the upper slewing body 13, the distance from the slewing center axis 13*a* to the specific part 15*t*, namely, the slewing radius of the specific part 15*t*, and the distance from the bottom surface of the work machine 10 to the specific part 15*t*, namely, the height of the specific part 15*t*.

The work plan setting unit 31 further sets a work phase to be included in the work plan among the plurality of work phases. The plurality of work phases includes, in the present embodiment, a series of work phases, namely, a capture phase, a lift-up slewing phase, a release phase, and a return slewing phase. The capture phase is a phase in which the end attachment 15*c* captures the work object, e.g., excavates earth and sand, in the target capture region Rct. The target capture region Rct is set in a place where the work object is collected, such as a pile of soil sand. The lift-up slewing phase is a phase in which the specific part 15*t* of the end attachment 15*c* is moved along the target lift-up slewing locus Lls from the target capture region Rct toward the target release region Rrt with the end attachment 15*c* capturing the work object. The release phase is a phase in which the end attachment 15*c* releases the work object, e.g., discharges soil, in the target release region Rrt. The target release region Rrt is set, for example, to a region over a loading platform of a transport vehicle. The return slewing phase is a phase in which the specific part 15*t* is moved along the target return slewing locus Lrs from the target release region Rrt toward the target capture region Rct. For example, the capture phase, the lift-up slewing phase, the release phase, and the return slewing phase are repeated sequentially in this order.

The work plan may be set into the work plan setting unit 31 by teaching, or may be set into the work plan setting unit 31 by a method other than teaching (for example, a numerical input). The teaching is performed as follows. Initially, an operator rides on the work machine 10 to operate the work machine 10 or remotely operates the work machine 10, thereby positioning the specific part 15*t* at a specific position in a region that the operator desires to set as the target region (each of the target capture region Ret and the target release region Rrt), the specific position being, for example, the position of the corner of the target capture region Rct. In this state, the work plan setting unit 31 sets the target region based on the position at which the specific part 15*t* is positioned. The operator also operates the work machine 10 so as to move the specific part 15*t* along a locus that the operator desires to set as the target locus (each of the target lift-up slewing locus Lls and the target return slewing locus Lrs). The work plan setting unit 31 sets the locus along which the specific part 15*t* has been thus moved to the target locus.

The monitoring controller 40 judges whether or not the motion of the work machine 10 is an abnormal motion. The monitoring controller 40 and the work machine controller 30 may be configured as a single controller, in other words, the single controller may be configured to serve as both the monitoring controller 40 and the work machine controller 30; alternatively, the monitoring controller 40 and the work machine controller 30 may be configured independently of each other.

As shown in FIG. 2, specifically, the monitoring controller 40 includes a target position acquisition unit 41, a normal motion region setting unit 43, an abnormal motion region setting unit 45, a current position acquisition unit 47, an abnormal motion judgment unit 51, and an abnormality handling unit 53.

The target position acquisition unit 41 acquires target position information that is information about the target position of the monitoring target part 19. As shown in FIG. 2, the target position acquisition unit 41 acquires the target position information from the work machine controller 30. Specifically, the target position acquisition unit 41 acquires target position information that is necessary for setting the abnormal motion region Rab shown in FIG. 4. The target position information, in the present embodiment, includes information about the work plan (target locus and target region), information about the current work phase, and the machine-body information. The target position information may be either three-dimensional information or two-dimensional information. The two-dimensional information may be, for example, either information on a position viewed from above the work site or information on a position in an image of the work site captured from an obliquely upward position.

Figure 4:
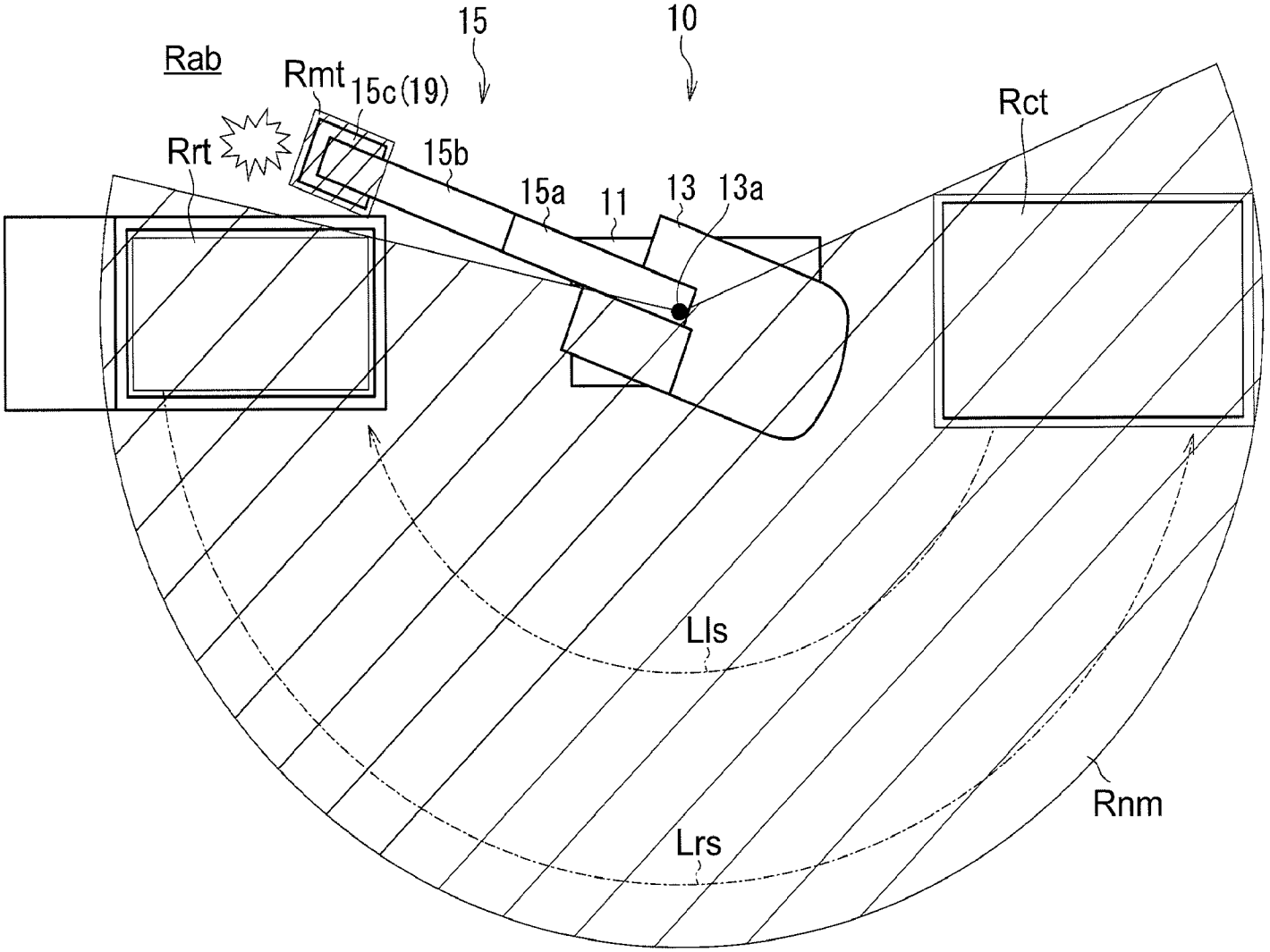

The normal motion region setting unit 43 sets, specifically, automatically calculates, the normal motion region Rnm shown in FIG. 4. The normal motion region setting unit 43 sets the normal motion region Rnm based on the target position information acquired by the target position acquisition unit 41. The normal motion region Rnm shown in FIG. 4 is set based on a region occupied by the monitoring target part 19 when the monitoring target part 19 is located at the target position. The normal motion region Rnm is set based on a position where the monitoring target part 19 is located (a position where the monitoring target part 19 is assumed to be located) when work is performed by the work machine 10 according to the work plan. The normal motion region Rnm does not have to be strictly coincident with the region occupied by the monitoring target part 19 when the monitoring target part 19 is located at the target position. The actual position of the monitoring target part 19 may be deviated from the target position even if the work machine 10 makes normal motion; therefore, the normal motion region Rnm may be set to a region larger than the region occupied by the monitoring target part 19 when the monitoring target part 19 is at the target position. For example, the degree of enlargement of the normal motion region Rnm with respect to the occupied region can be set based on the motion speed (target motion speed or actual motion speed), mass, etc. of the movable element (e.g., the upper slewing body 13 or the attachment 15) in the work machine 10. The normal motion region Rnm may be, for example, either a two-dimensional region in a plan view as shown in FIG. 4 or a three-dimensional region. Specific examples of the normal motion region Rnm are described later.

The abnormal motion region setting unit 45 shown in FIG. 2 sets, specifically, automatically calculates, an abnormal motion region Rab. The abnormal motion region setting unit 45 sets the abnormal motion region Rab based on the target position information acquired by the target position acquisition unit 41. More specifically, the abnormal motion region setting unit 45 sets the abnormal motion region Rab based on the normal motion region Rnm. The abnormal motion region Rab is set outside the region occupied by the monitoring target part 19 when the monitoring target part 19 is located at the target position. The abnormal motion region Rab is, for example, a region except the normal motion region Rnm. The abnormal motion region Rab may be either a two-dimensional region or a three-dimensional region. Specific examples of the abnormal motion region Rab are described later.

The current position acquisition unit 47 shown in FIG. 2 acquires a current position, which is the current position of the monitoring target part 19. The current position acquisition unit 47 sets a monitoring target region Rmt based on the current position. The monitoring target region Rmt does not have to be strictly coincident with the region occupied by the monitoring target part 19 located at the current position. The monitoring target region Rmt is a region including at least a part of the region occupied by the monitoring target part 19. The monitoring target region Rmt may be either a two-dimensional region or a three-dimensional region.

The current position acquisition unit 47 according to the present embodiment acquires the current position of the monitoring target part 19 from an image (a two-dimensional image or a three-dimensional distance image) captured from the outside of the work machine 10. Specifically, the current position acquisition unit 47 acquires the current position of the monitoring target part 19 from an image captured by the imaging device 25 placed outside the work machine 10.

The current position can be acquired also based on information transmitted from the work machine 10 (more specifically, from the work machine controller 30 shown in FIG. 2). In this case, however, the current position can be prevented from being exactly acquired by an error that may be present in the information transmitted from the work machine 10. It may occur, for example, in the case of failure in the posture detection unit 21 installed on the work machine 10, or the case of failure in the work machine controller 30 or the case of error in the machine information. The above "case of error in the mechanical information" is, for example, the case where the attachment 15 has been exchanged but the information (size, shape) of the attachment 15 after the exchange fails to be correctly input to the work machine controller 30. The failure in the work machine controller 30 may bring the work machine 10 into an abnormal motion or may cause erroneous information to be transmitted from the work machine controller 30 to the current position acquisition unit 47.

In contrast, the current position acquisition unit 47, which acquires the current position of the monitoring target part 19 from an image captured from the outside of the work machine 10 (specifically, by the imaging device 25 shown in FIG. 2) as described above, can correctly acquire the current position no matter whether the information transmitted from the work machine 10 is correct or not.

Specifically, the current position acquisition unit 47 may be configured either to determine the position of the monitoring target part 19 by means of image recognition by artificial intelligence or the like based on the two-dimensional image to set the monitoring target region Rmt based on the determined position, or to determine the position of the monitoring target part 19 based on the three-dimensional distance image to set the monitoring target region Rmt based on the determined position. The current position acquisition unit 47, alternatively, may be configured to perform: determining the region of the monitoring target part 19 in the photographed image based on the two-dimensional image; extracting three-dimensional information corresponding to the determined region; determining a three-dimensional position of the monitoring target part 19 based on the extracted three-dimensional information; and setting the monitoring target region Rmt based on the three-dimensional position.

The current position acquisition unit 47, alternatively, may acquire the current position of the monitoring target part 19 based on the posture of the work machine 10 detected by the posture detection unit 21 installed on the work machine 10. The current position acquisition unit 47, alternatively, may acquire the current position based on both the posture of the work machine 10 detected by the posture detection unit 21 and the image captured by the imaging device 25.

The abnormal motion judgment unit 51 shown in FIG. 2 judges whether or not the motion of the work machine 10 is an abnormal motion. Specifically, the abnormal motion judgment unit 51 judges whether or not the current position of the monitoring target part 19 acquired by the current position acquisition unit 47 is within the abnormal motion region Rab and judges the motion of the work machine 10 to be an abnormal motion when the current position is within the abnormal motion region Rab. The abnormal motion judgment unit 51, reversely, judges the motion of the work machine 10 to be not an abnormal motion (e.g., a normal motion) when the current position of the monitoring target part 19 is not within the abnormal motion region Rab.

The abnormal motion judgment unit 51 makes the judgment, for example, as follows. [Example 1a] The abnormal motion judgment unit 51 judges whether or not at least a part of the monitoring target region Rmt is within the abnormal motion region Rab (i.e., has come into the abnormal motion region Rab). [Example 1b] The abnormal motion judgment unit 51 judges whether or not at least a part of the monitoring target region Rmt is out of the normal motion region Rnm. [Example 2a] The abnormal motion judgment unit 51 judges whether or not the entire monitoring target region Rmt is within the abnormal motion region Rab. [Example 2b] The abnormal motion judgment unit 51 judges whether or not the entire monitoring target region Rmt is out of the normal motion region Rnm.

In accordance with the method for the judgment executed by the abnormal motion judgment unit 51, the normal motion region Rnm, the abnormal motion region Rab, and the monitoring target region Rmt are appropriately set. For example, in accordance with the method for the judgment, it may be performed to set the size of the monitoring target region Rmt relative to the region that is actually occupied by the monitoring target part 19 (including any case of being wider than, narrower than and coincident with the actual). This is similar for the normal motion region Rnm and the abnormal motion region Rab. Judging whether or not the monitoring target region Rmt is out of the normal motion region Rnm, as in each of Example 2a and Example 2b is substantially equivalent to judging whether or not the monitoring target region Rmt is within the abnormal motion region Rab, as in each of Example 1a and Example 1b. The combination of the setting of the normal motion region Rnm by the normal motion region setting unit 43 and the judgment by the abnormal motion judgment unit 51 on whether or not the monitoring target region Rmt is out of the normal motion region Rnm is substantially equivalent to the combination of the setting of the abnormal motion region Rnm by the abnormal motion region setting unit 45 and the judgment by the abnormal motion judgment unit 51 on whether or not the monitoring target region Rmt is within the abnormal motion region Rab.

The abnormality handling unit 53 shown in FIG. 2 performs a predetermined abnormality handling when the abnormal motion judgment unit 51 judges the motion of the work machine 10 to be the abnormal motion. The contents of the abnormality handling are, for example, prestored in the abnormality handling unit 53. Specific examples of the abnormality handling include restraining the motion of the work machine 10. For example, the abnormality handling unit 53 inputs a command for restraining the motion of the work machine 10 to the work machine controller 30. The restraint on the motion may be either a stop of only the monitoring target part 19 or a stop of the entire work machine 10. The restraint on the motion, alternatively, may be reducing the speed of the movement of the monitoring target part 19 or reducing the speed of the movement of the entire work machine 10. The abnormality handling, alternatively, may be an alert. For example, the abnormality handling unit 53 may make either the monitoring controller 40 shown in FIG. 2 or another element different from the monitoring controller 40 issue a warning. The warning is, for example, a warning by at least one of sound, light, display, and vibration. The abnormality handling unit 53 may perform both the restraint on the motion of the work machine 10 and the warning.

The abnormality handling unit 53 may change the content of the abnormality handling (the degree of the restraint on the motion of the work machine 10, the degree of warning, etc.) according to the situation when the abnormal motion is judged. For example, the abnormality handling unit 53 may change the content of the abnormality handling in accordance with any of the size of a part of the monitoring target region Rmt, the part overlapping the abnormal motion region Rab, the magnitude of the speed of the motion of the work machine 10, and the like.

The specific setting of the normal motion region Rnm and the abnormal motion region Rab is not limited. For example, the normal motion region Rnm and the abnormal motion region Rab may be set based on at least one of: (i) the target slewing angle of the upper slewing body 13 relative to the lower traveling body 11; (ii) the target position of the farthest part of the monitoring target part 19 from the slewing center axis 13*a* (e.g., a target working radius); (iii) the target height of the monitoring target part 19 (e.g., the vertical distance from the bottom surface of the work machine 10); and (iv) the target position information of the monitoring target part 19 in the entire or a part of the work plan.

The abnormal motion region Rab may be set based on a value related to a target position included in the target position information on the monitoring target part 19, for example, at least one value of the slewing angle, the working radius, and the height of the monitoring target part 19. Specifically, the target position acquisition unit 41 shown in FIG. 2 acquires target position information in each of the series of work phases (the capture phase, the lift-up slewing phase, the release phase, and the return slewing phase). The target position acquisition unit 41 acquires, for example, the slewing angle, the working radius, the height of the monitoring target part 19 and the like which are set in each of the series of work phases.

The normal motion region setting unit 43, for example, acquires or calculates the minimum value and the maximum value of the slewing angle of the upper slewing body 13 when the monitoring target part 19 is moved (more specifically, assumed to be moved) in accordance with the series of work phases. The normal motion region setting unit 43 calculates a region in which the monitoring target part 19 can be located during the change in the slewing angle between the minimum value and the maximum value, and sets the normal motion region Rnm based on the calculated region.

The normal motion region setting unit 43, alternatively, acquires or calculates the minimum value and the maximum value of the working radius under the assumption that the monitoring target part 19 is moved in accordance with the series of work phases. The normal motion region setting unit 43 calculates a region in which the monitoring target part 19 can be located during the change in the working radius between the minimum value and the maximum value, and sets the normal motion region Rnm based on the calculated region.

The normal motion region setting unit 43, alternatively, acquires or calculates the minimum value and the maximum value of the height of the monitoring target part 19 under the assumption that the monitoring target part 19 is moved in accordance with the series of work phases. The normal motion region setting unit 43 calculates a region in which the monitoring target part 19 can be located during the change in the height of the monitoring target part 19 between the minimum value and the maximum value, and sets the normal motion region Rnm based on the calculated region.

In the example shown in FIG. 4, the normal motion region Rnm includes a region in which the monitoring target part 19 can be located between the target capture region Rct and the target release region Rrt under the assumption that the monitoring target part 19 performs work in both the regions Rct, Rrt. The normal motion region Rnm includes a region in which the monitoring target part 19 can be located during the movement of the specific part 15*t* (e.g., the end attachment 15*c*) along the target lift-up slewing locus Lls and the target return slewing locus Lrs. In the example shown in FIG. 4, the normal motion region Rnm is a fan-shaped or substantially fan-shaped area when viewed from above. The normal motion region Rnm may be a three-dimensional region having a columnar shape that is fan-shaped when viewed from above, for example, such a shape as to be obtained by eliminating a part of a cylinder or a substantial cylinder. The abnormal motion region setting unit 45 sets the region except the normal motion region Rnm, that is, the region outside the normal motion region Rnm, to the abnormal motion region Rab.

As described above, the abnormal motion judgment unit 51 judges the motion of the work machine 10 to be an abnormal motion when at least a part of the monitoring target region Rmt comes into the abnormal motion region Rab. In the example shown in FIG. 4, the abnormal motion judgment unit 51 judges the motion of the work machine 10 to be an abnormal motion when the current slewing angle of the upper slewing body 13 becomes the slewing angle corresponding to the abnormal motion region Rab.

Figure 5:
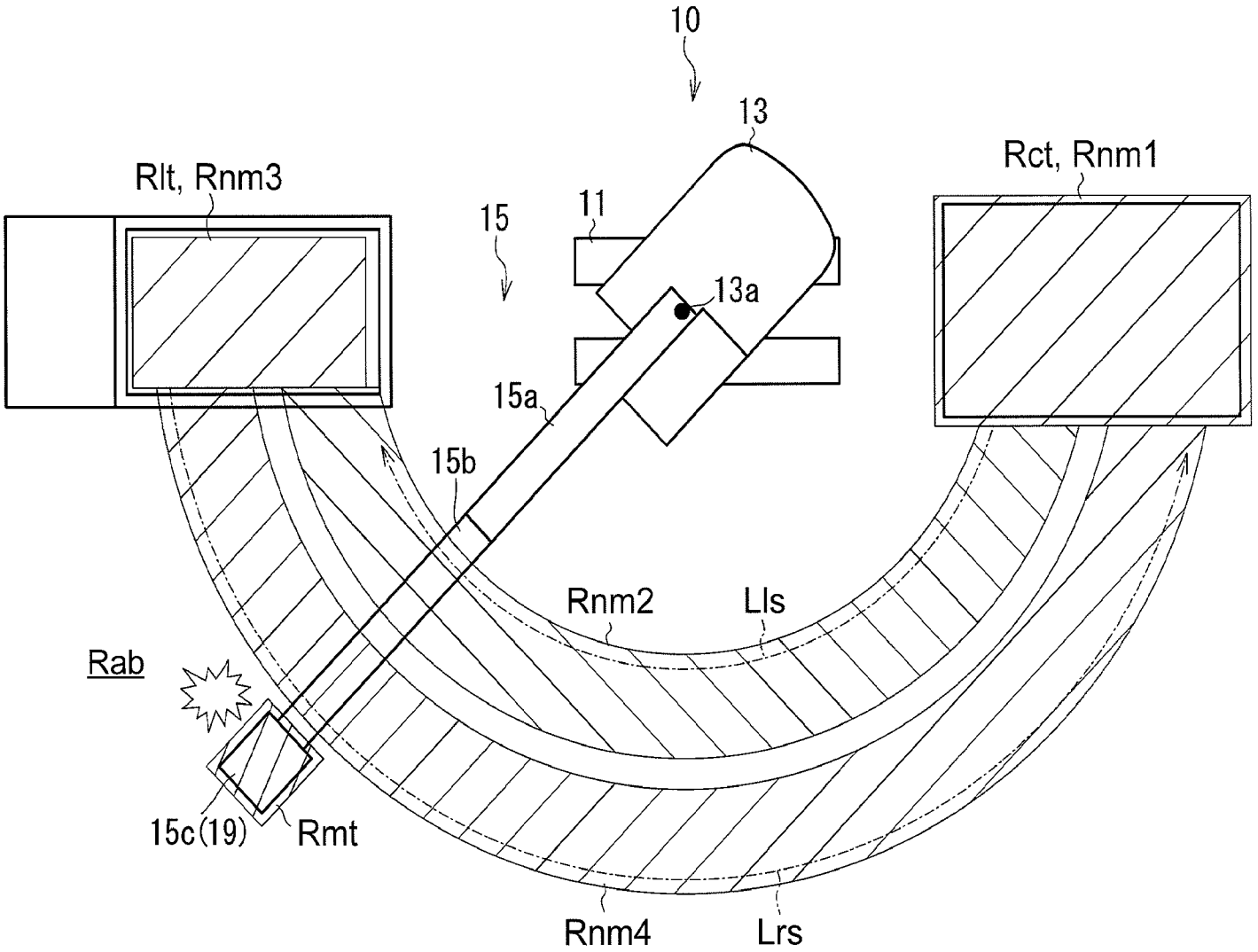
FIG. 5 is a plan view showing a normal motion region set for the work machine based on information on a plurality of work phases.

FIG. 5 shows an example in which the abnormal motion region Rab is set based on the target position information on the monitoring target part 19, which information is set for each of the series of work phases. In this example, the target position acquisition unit 41 shown in FIG. 2 acquires information in each of the series of work phases and sets a plurality of regions Rnm1, Rnm2, Rnm3, Rnm4 corresponding to the series of work phases, respectively. For example, the normal motion region setting unit 43 sets the region Rnm1, the region Rm2, the region Rnm3, and the region Rnm4 and sets the region in which the regions Rnm1 to Rnm4 are combined as the normal motion region Rnm. The region Rnm1 is set based on a region in which the monitoring target part 19 can be located under the assumption that the monitoring target part 19 performs work of capturing work object in the target capture region Rct in the capture phase. The region Rnm2 is set based on a region (locus) in which the monitoring target part 19 can be located during the movement of the specific part 15*t* along the target lift-up slewing locus Lls in the lift-up slewing phase. The region Rnm3 is set based on a region in which the monitoring target part 19 can be located when the monitoring target part 19 performs work of releasing the work object in the target release region Rrt in the release phase. The region Rnm4 is set based on a region (locus) in which the monitoring target part 19 can be located during the movement of the specific part 15*t* along the target return slewing locus Lrs in the return slewing phase. The abnormal motion region setting unit 45 sets the region except the normal motion region Rnm, that is, the region that is neither of the region Rnm1, the region Rm2, the region Rnm3, and the region Rnm4, as the abnormal motion region Rab.

The abnormal motion region Rab may be changed (switched) involved by the transition of the working phase, that is, the progress of work. For example, when the monitoring target part 19 is deviated from a region corresponding to the transition the work phase set in the work plan, that is, when the monitoring target part 19 makes movement to be deviated from a region corresponding to each of the series of work phases, the motion of the work machine 10 is judged to be an abnormal motion.

Specifically, the target position acquisition unit 41 acquires information about which work phase of the plurality of work phases the current work phase is. The target position acquisition unit 41 may acquire information on the next work phase following the current work phase or may acquire the information on the work phase to be performed thereafter. The target position acquisition unit 41 may acquire information on a series of (all) work phases. The target position acquisition unit 41 may update the target position when the target position of the monitoring target part 19 in the work phase is changed during the performance of the work by the work machine 10.

The normal motion region setting unit 43 sets the normal motion region Rnm according to the current working phase. Specifically, the normal motion region setting unit 43 sets the region Rnm1 as the normal motion region Rnm when the current working phase is the capturing phase. The normal motion region setting unit 43 sets the region Rnm2 as the normal motion region Rnm when the current working phase is the lift-up slewing phase. The normal motion region setting unit 43 sets the region Rnm3 as the normal motion region Rnm when the current work phase is the release phase. The normal motion region setting unit 43 sets the region Rnm4 as the normal motion region Rnm when the current working phase is the return slewing phase. On the other hand, the abnormal motion region setting unit 45 sets the abnormal motion region Rab in accordance with the current work phase.

Figure 6:
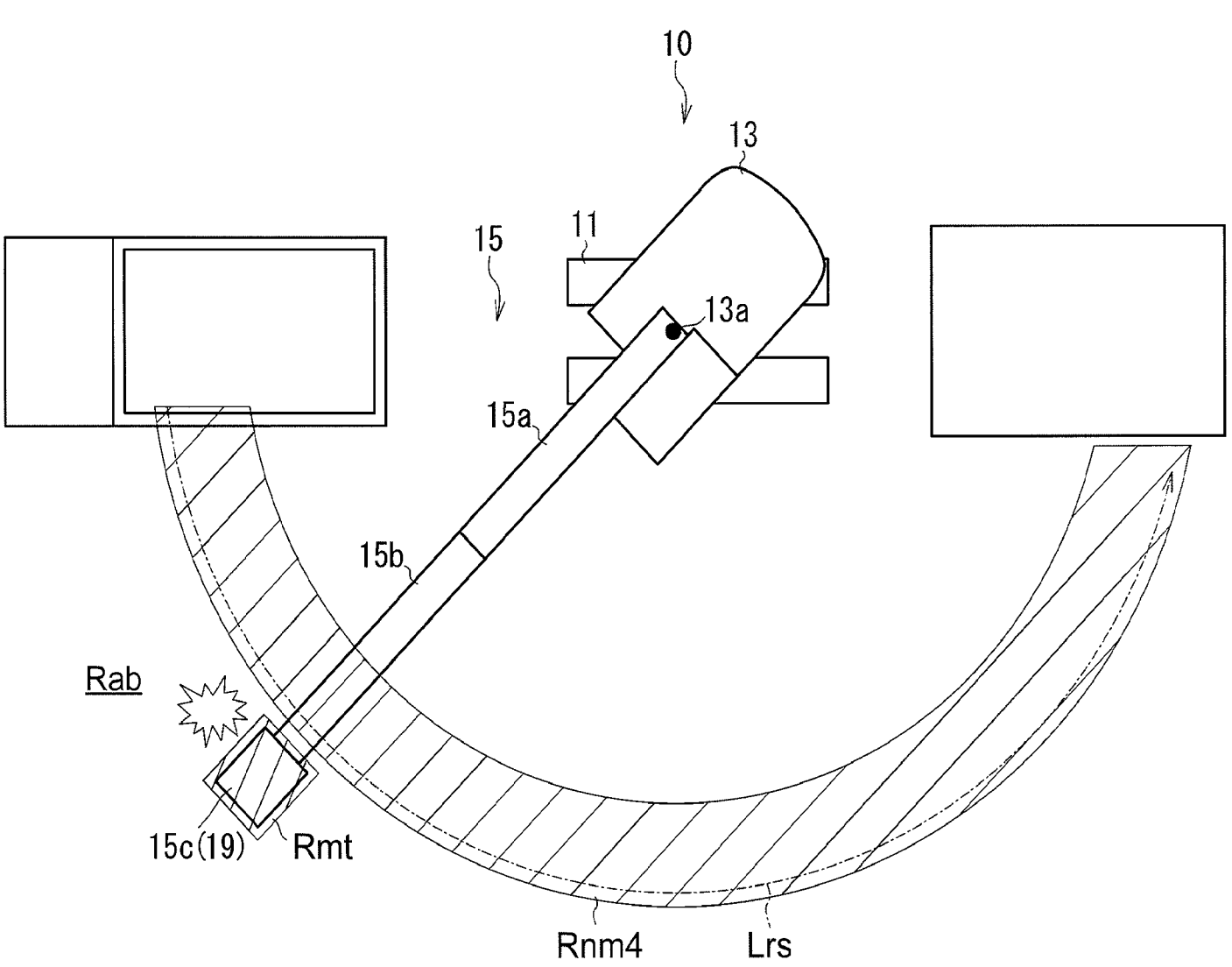
FIG. 6 is a plan view showing a normal motion region set for the work machine based on information on one work phase of the plurality of work phases.

FIG. 6 shows the state where the current working phase is the return slewing phase. The normal motion region Rnm in this state corresponds to the region Rnm4, and the abnormal motion region Rab is the region except the region Rnm4. In this state, when the monitoring target region Rmt is in the area outside the region Rnm4 (i.e., the area inside the abnormal motion region Rab), the motion of the work machine 10 is judged to be an abnormal motion even if the monitoring target region Rmt intrudes any of the regions Rnm1, Rnm2, and Rnm3 shown in FIG. 5.

Figure 7:
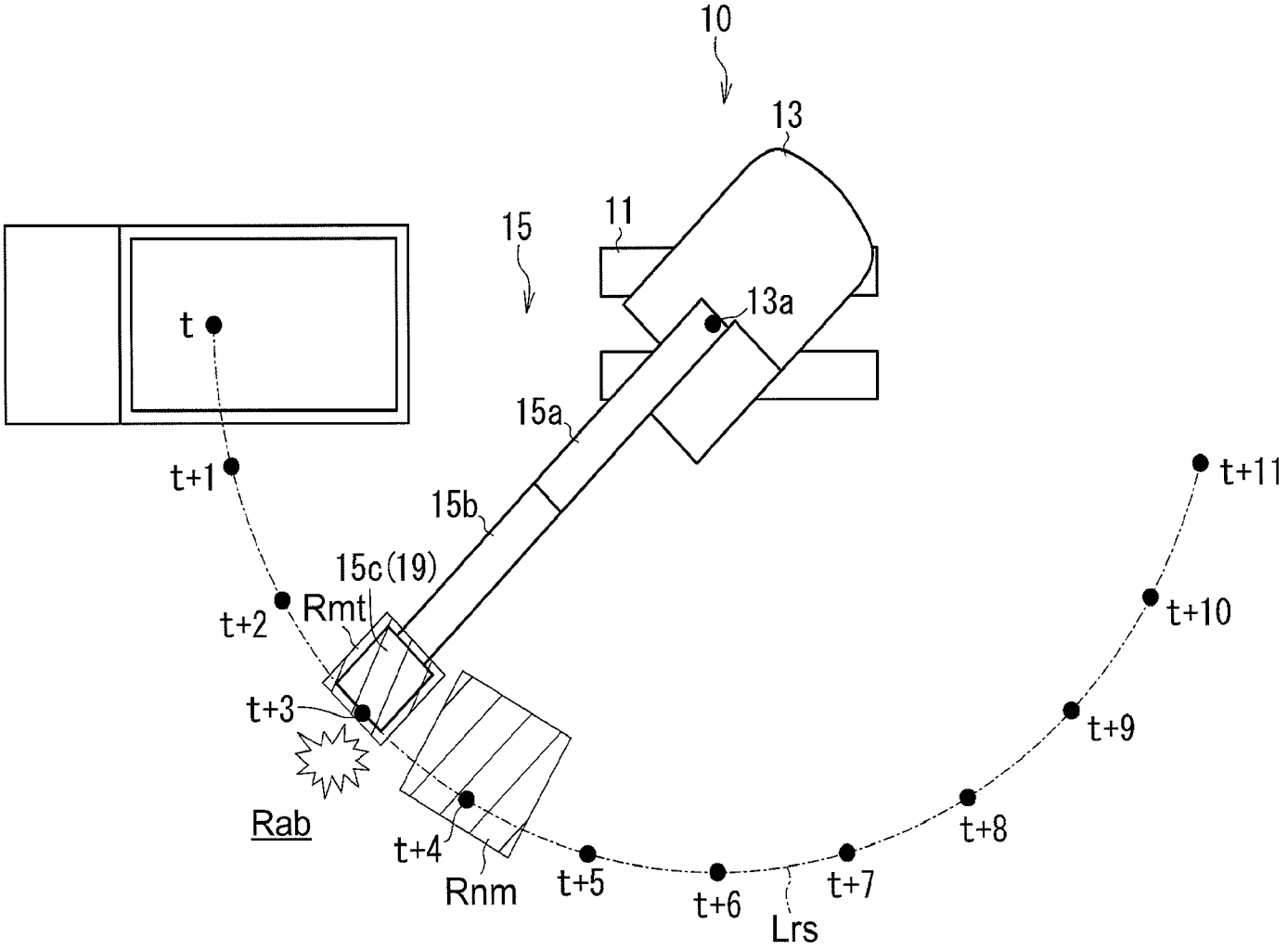
FIG. 7 is a plan view showing a normal motion region set for the work machine at a specific time.

As shown in FIG. 7, the abnormal motion region Rab may be varied every predetermined time. Specifically, the abnormal motion region Rab may be varied based on information on a relationship between a time that is set in the work plan and the target position of the monitoring target part 19 (time series information on the target position). In this case, the motion of the work machine 10 is judged to be an abnormal motion when the movement of the monitoring target part 19 does not correspond to the temporal change in the target position that is set in the work plan. For example, when the difference between the speed set in the work plan and the speed of the movement of the monitoring target part 19 is deviated from an allowable range, the motion of the work machine 10 is judged to be an abnormal motion. This enables a real-time judgment on the abnormal motion to be made in consideration with the movement speed of the monitoring target part 19.

As shown in FIG. 7, for example, the target position acquisition unit 41 acquires information (time series information) on the target position of the monitoring target part 19 every time a predetermined time is elapsed. The "predetermined time" is, for example, one second; however, it may be either less than one second or greater than one second. In the example shown in FIG. 7, the target position acquisition unit 41 acquires the target position of the monitoring target part 19 at time t+n (n is an integer equal to or greater than 0). The plurality of black points t, t+1, t+2, . . . indicate respective target positions of the monitoring target part 19 set for the times t, t+1, t+2, . . . on the target return slewing locus Lrs. The target position acquisition unit 41 may acquire either all of target positions from the start position (the position corresponding to the time t in the example shown in FIG. 7) of the monitoring target part 19 to the end position (the position corresponding to the time t+11 in the example shown in FIG. 7) in one phase of the series of work phases (e.g., the return slewing phase) or only a part of all the target positions. The target position acquisition unit 41 may acquire respective target positions for the current time (e.g., the time t4 shown in FIG. 7) and the times thereafter, for example, for the times t4, t5, 16 etc. As to the case where the work plan is changed during the motion of the work machine 10, e.g., the case where the target locus or the target speed is changed, it is preferable that the target position acquisition unit 41 is configured to acquire information related to the work plan that has been already changed (more specifically, acquires the target position of the monitoring target part 19 that has been already changed). In the case where the work plan is changed after the target position acquisition unit 41 has acquired the target position of the monitoring target part 19, the target position acquisition unit 41 may update the target position based on the work plan that has been already changed. These enable an appropriate abnormal motion region Rab to be set in accordance with the changes in the work plan.

The normal motion region setting unit 43 preferably sets the normal motion region Rnm each time the predetermined time is elapsed, switching the normal motion region Rnm every time the predetermined time is elapsed. In this case, the normal motion region setting unit 43 sets the normal motion region Rnm based on a region that the monitoring target part 19 can occupy when the monitoring target part 19 is located at a target position corresponding to a certain time.

For example, the normal motion region Rnm at the time t is set based on a region that the monitoring target part 19 can occupy when the monitoring target part 19 is at the target position that is set corresponding to the time t. For example, it is also possible that the target position acquisition unit 41 acquires a target position for the next time t+2, in advance, at the time t+1, and the normal motion region setting unit 43 determines the normal motion region Rnm at the time t+2. On the other hand, the abnormal motion region setting unit 45 sets the abnormal motion region Rab every time a predetermined time is elapsed, that is, switches the abnormal motion region Rab each time the predetermined time is elapsed.

Figure 8:
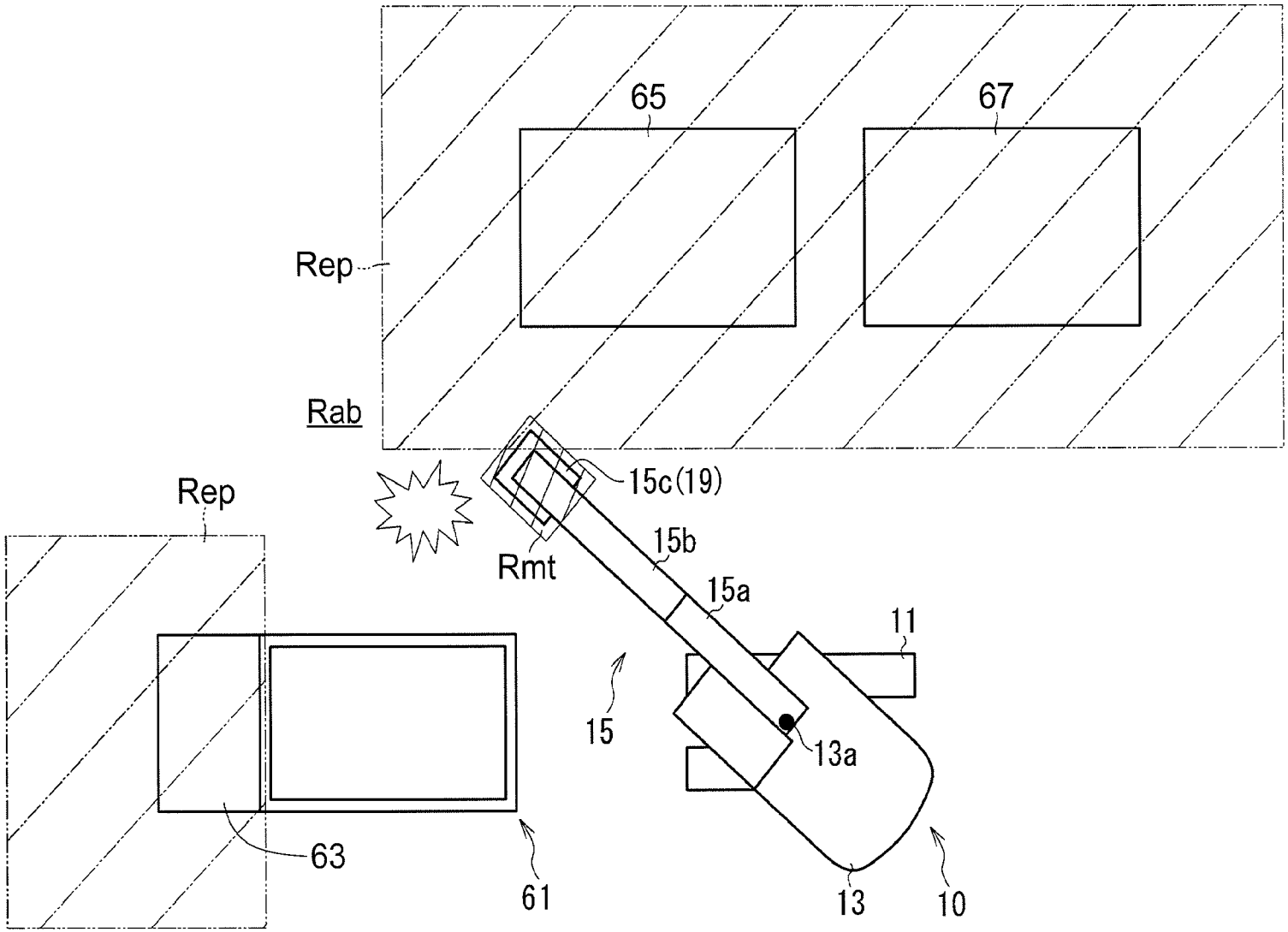
FIG. 8 is a plan view showing an entry prohibition region D set for the work machine.

The abnormal motion region setting unit 45 may set, as shown in FIG. 8, an entry prohibition region Rep around the work machine 10 within the abnormal motion region Rab. The entry prohibition region Rep includes a first region in which an object is present that may cause a problem by contact thereof with the monitoring target part 19, a second region around the first region, and the like. The entry prohibition region Rep may be set to a region into which a person can come. The region is, for example, the cab 63 of the transport vehicle 61 such as a dump truck as shown in FIG. 8 and the surrounding thereof, or building 65, 67 and the surroundings thereof. The abnormal motion region setting unit 45 may automatically set the entry prohibition region Rep, for example, based on either an image (a two-dimensional image or a three-dimensional distance image) captured by the imaging device 25 or information (for example, three-dimensional information) about a working site where work is performed by the work machine 10. The entry prohibition region Rep, alternatively, may be prestored in the abnormal motion region setting unit 45.

The embodiments may be variously modified. For example, the arrangement or shape of each component of the embodiment may be changed. For example, the connections between the components shown in FIG. 2 may be changed. Each of the above-described regions (e.g., the normal motion region Rnm shown in FIG. 4, the abnormal motion region Rab, the monitoring target region Rmt, and the entry prohibited region Reh shown in FIG. 8) may be variously set, for example, by manual operation, or automatically changed according to some conditions. For example, the number of components may be changed and some of the components may not be provided. For example, the fixation, connection, etc. of the components may be direct or indirect. For example, what has been described as a plurality of members or parts different from each other may be one member or part. For example, what has been described as one member or part may be provided separately in a plurality of members or parts different from each other.

Thus is provided a system capable of detecting that the motion of an automatically operated work machine is abnormal.

The system to be provided includes a work machine, a target position acquisition unit, an abnormal motion region setting unit, a current position acquisition unit, and an abnormal motion judgment unit. The work machine includes a monitoring target part and is automatically operated so as to move the monitoring target part. The target position acquisition unit acquires target position information which is information on a target position of the monitoring target part. The abnormal motion region setting unit sets an abnormal motion region based on the target position information acquired by the target position acquisition unit. The abnormal motion region is a region for judging that an abnormal motion is present when the monitoring target part is located within the abnormal motion region, being set outside the area occupied by the monitoring target part when the monitoring target part is located at the target position. The current position acquisition unit acquires information on a current position, which is a current position of the monitoring target part. The abnormal motion judgment unit judges whether or not the current position acquired by the current position acquisition unit is within the abnormal motion region.

According to the system, the abnormal motion judgment unit can accurately detect an abnormality of the position where the monitoring target part is actually located, based on the relationship between the abnormal motion region that is set based on the target position of the monitoring target part and the current position, and thereby detect an abnormality of the motion of the work machine which is automatically operated.

The monitoring target part can be arbitrarily set. For example, in the case where the work machine includes a lower traveling body, an upper slewing body, and an attachment, wherein the upper slewing body is mounted on the lower traveling body capably of slowing and the attachment is attached to the upper slewing body to perform a motion for work, the monitoring target part is preferably a distal end of the attachment. Since the distal end of the attachment 15 is typically a part that is directly related to the work, monitoring the position of the distal end of the attachment enables the abnormality in the motion of the work machine to be more appropriately detected.

The current position acquisition unit preferably acquires the information on the current position based on an image captured from outside of the work machine, for example, an imaging device. This enables the information on the current position of the monitoring target part to be accurately acquired based on the actual situation, no matter whether the information acquired by the work machine is correct or incorrect, unlike the case of acquiring the information on the current position based on only the information acquired by the work machine.

As to the case where the automatic operation of the work machine involves transition of work phases, it is preferable that the abnormal motion region setting unit is configured to change the abnormal motion region with the transition of the work phases. The abnormal motion setting unit, thus setting an appropriate abnormal motion region corresponding to each of the work phases, enables an abnormal motion of the work machine to be more appropriately detected.

Preferably, the target position acquisition unit acquires information on the target position each time a predetermined time is elapsed, and the abnormal motion region setting unit is configured to change the abnormal motion region Rab based on the target position each time the predetermined time is elapsed. The abnormal motion region setting unit, thus setting the abnormal motion region based on the information on the target position that is set each time the predetermined time is elapsed, enables the abnormal motion of the work machine to be detected with higher accuracy so as to follow the temporal change in the target position.

Preferably, the abnormal motion region setting unit further sets an entry prohibition region Rep around the work machine within the abnormal motion region. The comparison of the thus set entry prohibition region with the current position with each other makes it possible to more accurately avoid trouble which may be caused by the abnormal motion.

The invention claimed is:

1. An abnormal motion detection system comprising:

a work machine including a monitoring target part and automatically operated to move the monitoring target part;

a target position acquisition unit that acquires target position information which is information on a target position of the monitoring target part;

an abnormal motion region setting unit that sets an abnormal motion region outside an area occupied by the monitoring target part when the monitoring target part is located at the target position, based on the target position information acquired by the target position acquisition unit;

a current position acquisition unit that acquires information on a current position, which is a current position of the monitoring target part; and an abnormal motion judgment unit that judges whether or not the current position acquired by the current position acquisition unit is within the abnormal motion region.

2. The abnormal motion detection system according to claim 1, wherein the work machine includes a lower traveling body, an upper slewing body mounted on the lower traveling body capably of slewing, and an attachment attached to the upper slewing body to perform a motion for work, the monitoring target part being a distal end of the attachment.

3. The abnormal motion detection system according to claim 1, wherein the current position acquisition unit is configured to acquire information on the current position based on an image captured from outside of the work machine.

4. The abnormal motion detection system according to claim 1, wherein automatic operation of the work machine involves transition of work phases, and the abnormal motion region setting unit is configured to change the abnormal motion region with the transition of the work phases.

5. The abnormal motion detection system according to claim 1, wherein the target position acquisition unit is configured to acquire the target position information each time a predetermined time is elapsed, and the abnormal motion region setting unit is configured to change the abnormal motion region based on the target position information each time the predetermined time is elapsed.

6. The abnormal motion detection system according to claim 1, wherein the abnormal motion region setting unit is configured to further set an entry prohibition region around the work machine within the abnormal motion region.

* * * * *